US005505678A

United States Patent [19]

Johnston

[11] Patent Number: 5,505,678

[45] Date of Patent: Apr. 9, 1996

[54] LEVER OPERATED EXERCISE APPARATUS

[76] Inventor: Gary L. Johnston, P.O. Box 183, Cowarts, Ala. 36321

[21] Appl. No.: 216,341

[22] Filed: Mar. 23, 1994

Related U.S. Application Data

[63] Continuation-in-part of Ser. No. 151,178, Nov. 12, 1993, abandoned.

[51] Int. Cl.[6] ..... A63B 21/02; A63B 23/04

[52] U.S. Cl. ..... 482/52; 482/80

[58] Field of Search ..... 482/51, 52, 53, 482/70, 71, 56, 79, 80

[56] References Cited

U.S. PATENT DOCUMENTS

| | | | |
|---|---|---|---|
| 1,966,448 | 7/1934 | Kabisius | 482/56 |
| 2,079,594 | 5/1937 | Clem | 482/53 |
| 4,900,012 | 2/1990 | Fu | 482/52 |
| 5,199,932 | 4/1993 | Liao | 482/53 |

*Primary Examiner*—Stephen R. Crow

[57] ABSTRACT

A lever operated exercise apparatus is provided which a user operates while in a standing position. The apparatus includes a foot engagement assembly mounted on a frame structure. The foot engagement assembly comprises two foot engaging members which are coupled to the frame structure to move in a substantially vertical direction. A power translating mechanism comprising a lever operatively connects the frame structure and the foot engagement assembly such that a downward force applied to one of the foot engaging members produces an upward force on the other foot engaging member. This causes the foot engaging members to move in opposite direction from one another. The power translating mechanism may have two levers rigidly mounted together and connected to the foot engaging member at two different locations. This double lever keeps the foot engaging members in a substantially horizontal position while they move in a substantially vertical direction.

12 Claims, 5 Drawing Sheets

LEVER OPERATED EXERCISE APPARATUS

BACKGROUND OF THE INVENTION

1. Cross-Referenced to Related Applications

This application is a Continuation-in-Part of U.S. application Ser. No. 08/151,178, entitled "Elevating Exercise Apparatus", filed Nov. 12, 1993, now abandoned.

2. Field of the Invention

This invention relates to a lower body exercise device and in particular to an exercise device upon which the user, while in a standing position, pushes downward upon one side of the device with their foot, causing the opposite foot to be elevated in a substantially vertical direction, with both feet of the user remaining in a substantially horizontal position. The user then pushes the elevated foot downward upon the device, thereby producing upward movement of the previously down foot, again in the substantially vertical direction and occurring with the feet of the user remaining in a substantially horizontal position. This action is repeated back and forth to provide a side stepping type of exercise routine not found in current lower body exercise devices.

3. Description of the Prior Art

Presently there exists many variations of lower body exercise devices which utilize a type of stepping motion. These include stair-stepper machines and treadmills. While these units offer relatively good lower body exercise routines, they all appear to be one dimensional. Stair-stepper machines usually have a foot rest member pivotally/mounted to the frame, with the user having to step downward at an angle to perform the desired exercise routine. The motion of the user is therefore at an angle, not in a true upward and downward direction. Some stair-stepping devices do have foot rest members which move with the position of the feet, but the feet do not maintain a substantially horizontal position at all times and do not move in a substantially vertical direction. Treadmills only offer a type of walking or jogging step motion, in which the user only feels resistance when their foot contacts the belt surface. In addition, there is prior patented art, cited in the parent application of which this application is a Continuation-in-Part, which show stepping exercise devices which utilizing a foot rest member. The foot rest members are not pivotally connected to the frame, but move along a guided path. These include:

U.S. Pat. No. 4,842,268 to Jenkins demonstrates an exercise device having foot rest members moving in opposite upward and downward direction through a drive belt and pulley type of power translating mechanism. Each foot rest member is supported at its proximate center by a support member which extends from one side to the other. The foot rest member is mounted to a guide means located along its side.

U.S. Pat. No. 4,958,830 to Huggins et al. demonstrates an exercise device having foot rest members moving in opposite upward and downward directions, slightly angled, through a combined chain, sprocket and lever type of power translating mechanism. Each foot rest member is supported at its proximate center by a support member which extends from one side to the other. The foot rest member is mounted to a guide means located along its side.

U.S. Pat. No. 5,199,932 to Liao demonstrates an exercise device having foot rest members moving in opposite upward and downward directions, slightly angled, through a hydraulic type of power translating mechanism. Each foot rest member is supported at its proximate center by a support member which extends from one side to the other. The foot rest member is mounted to a guide means located along its side.

G.B Pat. No. 2,010,101 to Hickman demonstrates an exercise device having foot rest members moving in opposite upward and downward direction, along an angle, through a roller and strap type of power translating mechanism. Each foot rest member is supported and guided along both sides.

U.S. Pat. No. 4,676,501 to Hoagland et al. demonstrates an exercise device having foot rest members moving in opposite upward and downward directions through an electric motor and lever type of power translating mechanism. Each foot rest member is supported and guided along both sides.

U.S. Pat. No. 4,900,012 to Fu demonstrates an exercise device having foot rest members moving independently in the upward and downward direction utilizing a spring type of power translating mechanism. Each foot rest member is supported and guided along both sides.

U.S. Pat. No. 5,267,922 to Robinson demonstrates an exercise device having foot rest members moving in opposite upward and downward directions, at an angle, through a pulley and cable type of power translating mechanism. Each foot rest member is supported and guided along its front end.

U.S. Pat. No. 2,079,594 to Clem demonstrates an exercise device having foot rest members moving in opposite upward and downward directions through a hydraulic type of power translating mechanism. Each foot rest member is supported and guided along its front end.

U.S. Pat. No. 4,786,050 to Geschwender demonstrates an exercise device having foot rest members moving in opposite circular motion, slightly slanted, through a pulley, belt and lever type of power translating mechanism. Each foot rest member is supported and guided at the front and rear of one side.

U.S. Pat. No. 1,990,124 to Kabisius demonstrates an exercise device having foot rest members pivotally mounted at one end to a frame and to a mechanical crank and lever type system. Each foot rest member is supported and guided at one end.

None of the above inventions and patents, taken either singly or in combination, is seen to describe the instant invention as claimed. Jenkins, Huggins, Hickman, Robinson, and Geschwender all demonstrate types of power translating mechanisms which utilize a type of belt and pulley system. Huggins and Geschwender do include lever means, but they are used very differently from the lever means in this invention. Liao and Clem utilize a type of hydraulic or pneumatic power translating mechanism. Fu demonstrates a type of exercise device using springs to act against the movement of the foot members. Kabisius utilizes a type of power translating mechanism comprised basically of a crank system, with one of the crank link being a type of lever. However, this invention is much different from the one described and claimed in this specification. Hoagland does demonstrate a type of power translating mechanism which uses levers to transmit power. However, these forces are transmitted from a motor means to each foot member, not from one foot member to the other.

This new exercise device offers a new type of stepping exercise in which forces continuously act against the user in the substantially vertical direction. The user pushes downward upon a first foot member which is moveably coupled to a device frame. A second foot member is also moveably coupled to the device frame. A lever means is pivotally mounted at its proximate center to the device frame. One end of the lever means is connected to the first foot member while the other end is connected to the second foot member. As the user steps downward upon one foot member, the other foot member moves upward. Given the fact that there are vast number of exercise devices on the market today, it has come as a surprise that no one has effectively designed a device upon which the user may perform this type of stepping exercise routine utilizing a lever means for power translation.

SUMMARY AND OBJECTS OF THE INVENTION

It is the object of this invention to provide a stepping device which is comfortable, easy, and safe to operate while in a standing position. One version may allow for manual operation of the device, with the upward and downward stepping motion being induced by the user. A second version of the device may allow for automatic operation of the device whereby the upward and downward stepping motion is induced by a motor. Both of these features will offer a better and more versatile workout than found on current stepper and treadmill type exercise devices.

It is the further object of this invention to provide a lower body exercise device which may include a handle men, bet for use in maintaining proper balance. The handle may also be used in conjunction with the feet to operate the device, thereby allowing the user to exercise both upper and lower body muscle groups. The handle member may also be adjustable to compensate for various user heigths.

Briefly stated, the apparatus that forms the basis of the present invention comprises basically a structural frame means, a foot engagement means, and a power translating mechanism. The power translating mechanism comprises an optional shaft member and at least one lever means. The device may also include a hand engagement means which may be used for balancing purposes, or may be used in conjunction with the foot engagement means for operating the device. The device may also include a resistance means which may operate in conjunction with the power translating mechanism. This would be for manual operation of the device. Another version of the device may include a motor means for automatic operation.

The structural frame means may include support members which form a strong support base. The foot engagement means and the power translating mechanism mount upon this frame. The hand engagement means may also mount upon the frame or may mount upon the foot engagement means, whichever is preferred.

As stated previously, a resistance means may be included for manual operation of the device. It may mount as a separate component on the frame and connect to the power translating mechanism. It would operate in conjunction with the foot engagement means to provide a force against the user during the side stepping motion. The amount of resistance may be adjustable to provide the desired resistance force. Instead of a resistance means, a motor means may mount as a separate component upon the frame and connect to the power translating mechanism for automatic operation of the device. The stepping motion of the device would be induced by the motor, not the user.

Also, if a hand engagement handle is to be used, the handle may be upwardly and downwardly adjustable to compensate for different user heigths. As previously stated, the hand engagement handle may be connected to the frame and used for balancing purposes, or it may be connected to the foot engagement means and used for upper body workout routines.

Also, a conventional exercise computer may be part of the apparatus. It will not be shown in the accompanying figures, but may connect to the foot engagement means or the power translating mechanism and keep track of exercise related data such as number of steps, time, calories, etc.

Other objects, features, and advantages for this invention will be apparent from the following detailed description and the appended claims, references being made to the accompanying drawings forming a part of the specification, wherein like reference numerals designate corresponding parts of several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description, and not limitation.

Figure 1A:
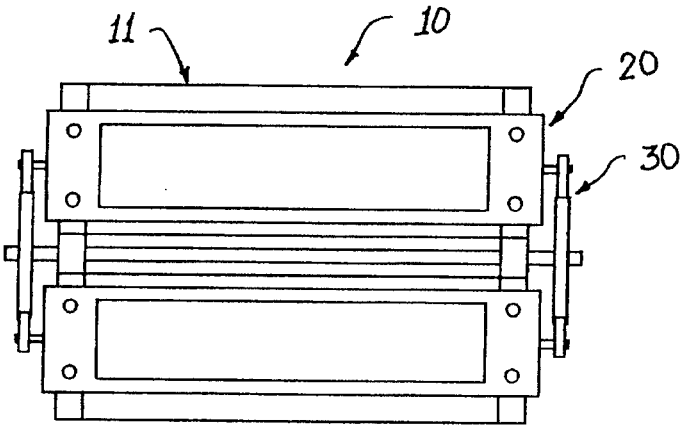
FIG. 1A is a top view of the lever operated exercise apparatus.
Figure 1B:
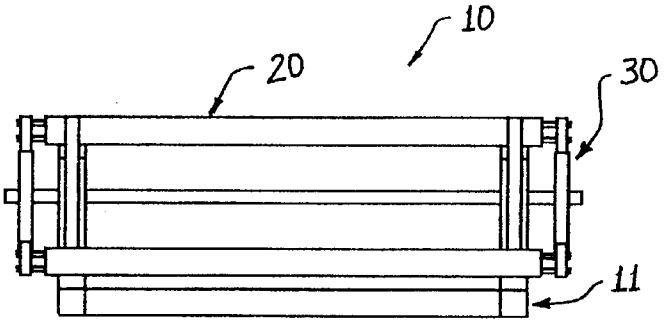
FIG. 1B is a side view of the lever operated exercise apparatus.
Figure 1C:
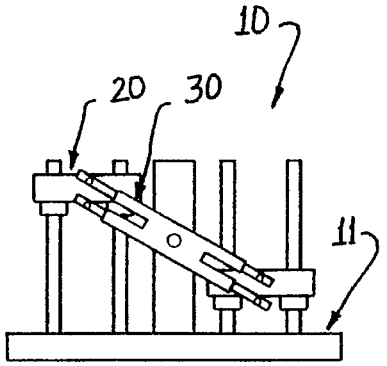
FIG. 1C is a front view of the lever operated exercise apparatus.

As best can be seen by references to the drawings, and in particular to FIGS. 1A, 1B, and 1C, the lever operated exercise apparatus that forms the basis for the present invention is designated generally by the references numeral 10. Lever operated exercise apparatus 10 basically comprises a structure frame means 11, a foot engagement means 20, and a power translating mechanism 30.

Other components such as a hand engagement means, a resistance means, and a motor means may also be a part of the lever operated exercise apparatus 10. The hand engagement means may be used by the user for balancing purposes or as an upper body workout addition. The resistance means may be used to provide a resistance in the upward and downward movement of the foot engagement means 20 as induced by the user during manual operation of the device. The motor means may be used to induce motion in the foot engagement means 20 during automatic operation of the device. Both of these features will be described later on in the specification.

Figure 2A:
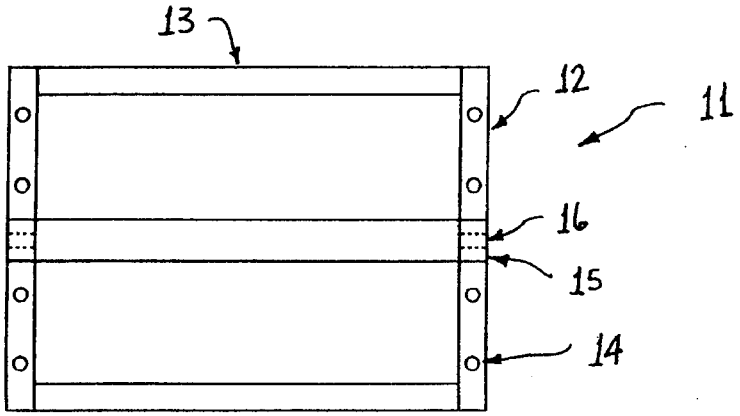
FIG. 2A is a top view of the structural frame means of the lever operated exercise apparatus.
Figure 2B:
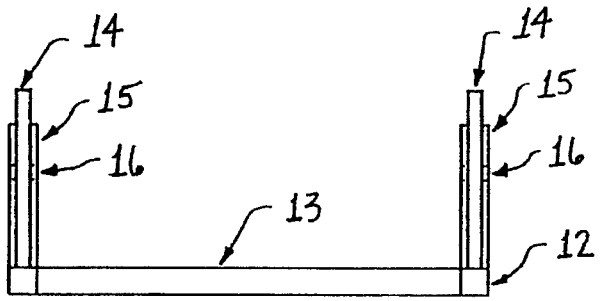
FIG. 2B is a side view of the structural frame means of the lever operated exercise apparatus.
Figure 2C:
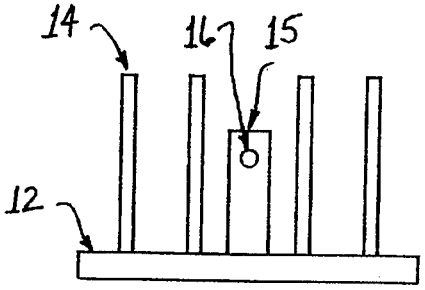
FIG. 2C is a front view of the structural frame means of the lever operated exercise apparatus.

Referring to FIGS. 2A, 2B, and 2C, structural frame means 11 comprises base support members 12, cross members 15, guide members 14, and mechanism mounts 15. Base support members 12 are elongated support structures used to support guide members 14 and mechanism mounts 15. One base support member 12 is located at the front and rear ends of the structural frame means 11. Cross members 13 are also elongated support structures which are used to connect the base support members 12. These create a more sturdy overall structure. Guide members 14 are mounted on base support members 12 and are upwardly extending support elements used to guide the foot engagement means 20 in a substantially vertical direction. The mechanism mounts 15 are used to support the various components of the power translating mechanism 30 and mount upon base support members 12. Each mechanism mount 15 may contain a mount opening 16, if a shaft is to be utilized by the device.

Figure 3A:
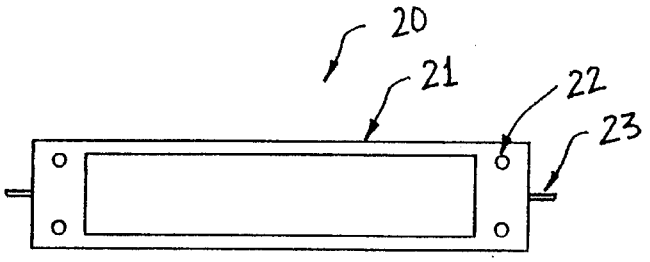
FIG. 3A is a top view of the foot engagement means of the lever operated exercise apparatus.
Figure 3B:
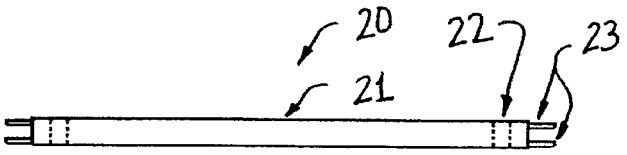
FIG. 3B is a side view of the foot engagement means of the lever operated exercise apparatus.
Figure 3C:
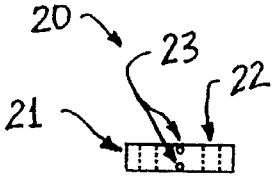
FIG. 3C is a front view of the foot engagement means of the lever operated exercise apparatus.

As may be seen in FIGS. 3A, 3B, and 3C, the foot engagement means 20 comprises foot engaging members 21 which are relatively flat structures upon which the user places their feet. Each foot engaging member 21 contains guide openings 22 at each end for receiving guide members 14 of structural frame means 11. Foot engaging members 21 also have rod-like foot member connectors 23 extending from each end, which are used to connect the foot engaging members 21 with the power translating mechanism 30.

Figure 4A:
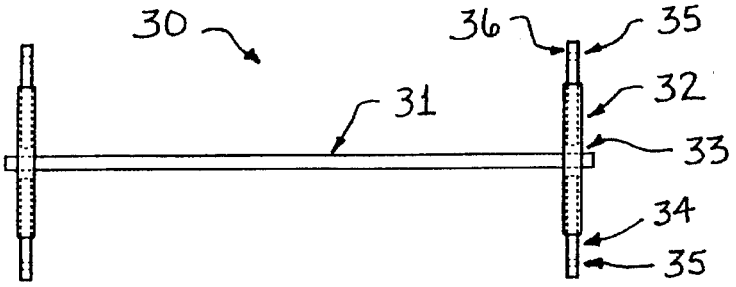
FIG. 4A is a top view of the power translating mechanism of the lever operated exercise apparatus.
Figure 4B:
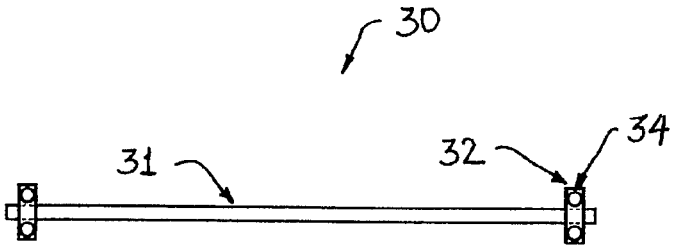
FIG. 4B is a side view of the power translating mechanism of the lever operated exercise apparatus.
Figure 4C:
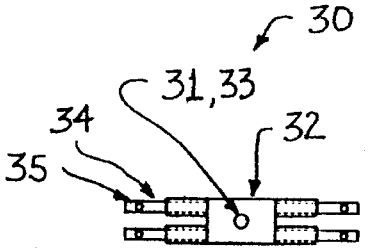
FIG. 4C is a front view of the power translating mechanism of the lever operated exercise apparatus.

Shown in FIGS. 4A, 4B, and 4C are the various components of the power translating mechanism 30. These include optional shaft member 31, and a lever means comprising lever connection member 32, lever connection opening 33, sliding connector 34, and sliding connector openings 35. If a shaft member 31 is to be utilized, it will turnably mount through mount opening 16 of mechanism mounts 15. Lever connection member 32 would thus rigidly mount on shaft member 31, one at each end or only one at the proximate center. If a shaft member 31 is not utilized, the lever connection member 52 would pivotally mount in some manner to the structural frame means 11. Having a shaft member 31 will probably prove the better configuration.

Figure 5A:
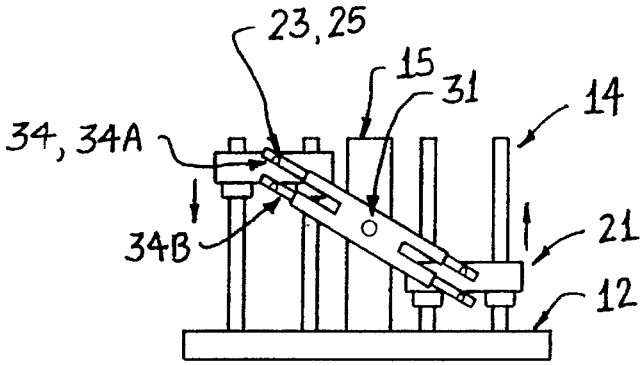
FIG. 5A is a front view of the lever operated exercise apparatus demonstrating one of the operating positions of the apparatus.
Figure 5B:
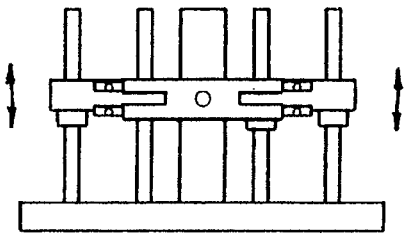
FIG. 5B is another front view of the lever operated exercise apparatus demonstrating another operating position.
Figure 5C:
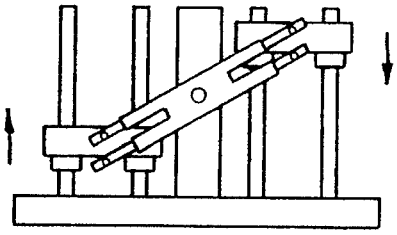
FIG. 5C is another front view of the lever operated exercise apparatus demonstrating another operating position.

FIGS. 5A, 5B, and 5C demonstrate from one side view the operation of the lever operated exercise apparatus by showing different operating positions of the apparatus. The other side of the apparatus would be configured identically. As seen, the foot engaging members 21 will slide upward and downward in a substantially vertical direction along guide members 14. Guide bearings, which may be a type of sliding, rolling, or ball bearing, may be placed in the guide openings 22 to assist with the sliding motion. At least one guide member 14 should be coupled to each end of the foot engaging member 21 to keep the member in a substantially horizontal position as it moves upward and downward. The drawings demonstrate two guide members 14 at each end and this will probably prove to provide better guidance than having only one.

As seen, when a shaft is utilized, the foot engaging members 21 are connected to shaft member 51 through lever connection member 32. Lever connection member 32 may be rigidly mounted to shaft member 31 through lever connection opening 33. Shaft member 31 is turnably mounted to mechanism mount 15 through mount opening 16. A shaft bearing, such as a bushing or ball bearing, may be placed within mount opening 16 to allow easier rotation. If a shaft member 31 is not used, the lever connection member 32 may pivotally mount upon a fixed axle located on the structural frame means 11. As seen, lever connection member 32 has a sliding connector 34 on each side which slides back and forth within. Each end of the sliding connector 34 is loosely connected to the foot member connector 23 of foot engagement means 20 through lever connection opening 33. Therefore, downward motion of one foot engaging men, bet 21 will produce partial rotation in lever connection member 32. Because the two foot engaging members are located on opposite sides of the lever connection member 32, upward motion will occurr in the second foot engaging member 21.

In the above situation, guide members 14 are used to keep the foot engaging members 21 from rotating when forces are not applied at the direct center. It may be possible to utilize additional sliding connectors 34 to prohibit rotation in foot engaging members 21. As may be further seen, it may be desireable to have two sliding connectors, 34A and 34B, one located above the other on each side of lever connection member 32. They loosely connected to two foot member connectors, 23A and 23B, of foot engagement means 20, which are in proximate vertically alignment. This use of multiple sliding connectors 34 will allow easier upward and downward movement of foot engaging members 21, since the guides members 14 will thus be used only to guide the foot engaging members in the substantially vertical direction.

As may be visualized by FIGS. 5A, 5B, and 5C, the downward motion of one foot engaging member 21 will correspond with an upward motion in the second foot engaging member 21, since they are connected by a lever means mounted on structural frame means 11. If shaft member 31 is to be utilized, then it will turn backward and forward as foot engaging members 21 move upward and downward, and vice versa. The main purpose of a shaft member is to allow outside forces, such as those produced by a resistance means or a motor means, to be exerted on the foot engaging members 21.

A desireable feature of the foot engaging members may be that they have sufficient length so that the user may simulate forward and backward stepping. The user may place one foot towards the front of one of the first foot engaging members and the other foot towards the back of the second foot engaging member. By stepping while in this position, the user creates a forward and backward stepping routine, which is not found on any other stepping devices. The user may then reverse feet position and perform the stepping routine again. Having an apparatus with a shaft member would allow for easier movement of the foot engaging members when performing this routine, and also allow better application of external forces.

As mentioned previously, a generally inverted U-shaped hand engagement means may be a part of the apparatus and may serve several purposes. It may be used to assist the user in maintaining proper balance, and it may also be used to provide an upper body workout. The hand engagement means may comprise a hand engaging handle with two downwardly extending handle support members, each having handle support holes. These members may be tubular structures containing handle support holes through the side and located at the end of each handle support members. Also part of the hand engagement means may be handle mounts, which have handle mount holes also through the side. The handle mounts may also be tubular in design and may be rigidly mounted on structural frame means 11 along one of the cross support members 15, or may be mounted on the foot engaging member 21 of foot engagement means 20, or both locations.

As stated, each end of handle support member contains a hole through the side. The handle mount also has holes through its side. Handle mount has a larger diameter than the handle support members, thereby allowing handle support members to fit within. Once inside, the holes are aligned and the members and mounts are secured together through some type of securing means such as a pin or bolt. When the hand engaging handle is mounted to the cross support member 13, it may be used primarily for balancing purposes. When the hand engaging handle is mounted to the foot engaging member 21, it may be used primarily as an upper body workout device, in that the user will be able to produce downward motion in the foot engaging member 21 both with their foot and with their hand.

As mentioned previously, a resistance means may also be part of the apparatus to provide a resistance in the upward and downward movement of the foot engaging members. The resistance means may be a commonly seen type of resistance device which may comprise a resistance mount, a circular member, a friction belt, a threaded shaft, a threaded opening, and a knob means. The resistance mount may connect to the structural frame means 11 or may be a part of it. The resistance mount may contain a threaded opening through which a threaded shaft turns. The threaded shaft has a knob means fixedly mounted on one end which is used to turn the threaded shaft. Loosely connected to the other end of the threaded shaft is a friction belt, which does not turn as the knob is turned. The friction belt may be an endless belt which extends around at least a portion of the periphery of a circular member. The circular member may be rigidly mounted upon shaft member 31 of the power translating mechanism 30, and will turn simultaneously with shaft member 34. If a shaft member is not utilized, it would be possible to rigidly mount the circular member to lever connection member 32, but would not allow for a very balanced apparatus, although the apparatus might still function. As the user pushes downward upon the foot engaging member 21 of the foot engagement means 20, motion will occur in the circular member. The amount of force exerted by the friction belt upon the circular member will correspond to the amount of resistance encountered by the user as they push downward upon foot engaging member 21. The amount of force exerted by the friction belt may be adjusted through the knob means. When the knob means is turned in one direction, the threaded shaft will turn accordingly and move upward, causing the friction belt to tighten against the circular member, increasing the resistance force. Upon turning the knob in the other direction, the belt will loosen, thereby decreasing the resistance force.

A motor means which may be used in conjunction with the shaft member 31 of the power translating mechanism 30 to produce automatic motion in the foot engaging members 21. The motor means may comprise a motor mount, a motor having a motor shaft, and a rocker-crank linkage assembly comprising a crank link, coupler link, and rocker link. The links may be pivotally connected together using linkage connectors. The motor may mount upon a motor mount, and the crank link is rigidly mounted to the motor shaft. The rocker link is rigidly mounted to shaft member of the power translating mechanism 30. The coupler link connects the crank link and the rocker link together. Therefore as the motor shaft rotates, so will the crank link. As the crank link rotates, the rocker link will rock backward and forward, causing shaft member 31 to rotate backward and forward. The motion of shaft member 31 will turn lever connection member 32 backward and forward, causing foot engagement members 21 to move oppositely upward and downward. The degree to which shaft member 31 rotates backward and forward is dependent upon the length of the crank, coupler, and rocker links. By altering their lengths or changing the points at which the links are connected together, the user may change the amount of rotation in shaft member 31 and thus change the levels to which the foot engaging members 21 move upward and downward.

There are many modifications, variations, and alterations which may be made to the apparatus described in this application. Different types of guide means, resistance means, motor means, etc., may be used to provide identical operating functions. Many variations of the power translating mechanism also exist, specifically the lever means. These include lever means having sleeve-like members connected to the foot members which slide upon a lever arm. Another example is a lever means in which a lever has ends which have elongated slots. The foot engagement members mount to the lever means through these elongated slots. These, along with the lever means described in the specification, are examples of levers with adaptably adjustable end segments which adapt to the vertical positioning of the foot members. Also, each lever means described above may have adaptably adjustable end segments connected to the foot engaging members at more than one point, the connections points being at different locations on the foot engaging members. This would be to minimize rotation. For example, the lever means comprising a lever with an elongated slot at each end might now have two elongated slots at each end. The foot engaging member is now connected through both elongated slots.

While it will be apparent that the preferred embodiment of the invention herein is well-calculated to fulfill the objects above stated, it will be appreciated that the invention is susceptible to modification, variation, and change without departing from its proper scope or fair meaning of the subjoined claims.

I claim:

1. An exercise apparatus comprising:

a structural frame means comprising a rigid frame; and guide members mounted to said rigid frame, said guide members being mounted near the front and rear of said rigid frame; and two foot engaging members, each foot engaging member having a front and rear portion, the front portion being coupled to at least one of said guide members mounted near the front of said rigid frame of said structural frame means, and the rear portion being coupled to at least one of said guide members mounted near the rear of said rigid frame of said structural frame means, such that said foot engaging members move in a substantially vertical direction; and a power translating mechanism operatively connecting said foot engaging members and said structural frame means for translating the downward force applied to one of said foot engaging members into an upward force on the second of said foot engaging members, thereby moving said foot engaging members in opposite directions from one another, whereby the user may perform a stepping exercise routine whereby the feet of the user move opposite one another in a substantially vertical direction.

2. The exercise apparatus as claimed in claim 1, wherein each of said guide members of said structural frame means comprises an elongated structure extending in a substantially vertical direction.

3. The exercise apparatus as claimed in claim 1, wherein each of said foot engaging members comprise:

a relatively flat structure upon which a user places a foot while in a standing position; and guide openings extending in a substantially vertical direction through said flat structure, at least one guide opening located near the front of said fiat structure and loosely receiving one of said guide members mounted near the from of said rigid frame of said structural frame means, and at least one other guide opening located near the rear of said fiat structure and loosely receiving one of said guide members mounted near the rear of said rigid frame of said structural frame means, thereby coupling said foot engaging member to said structural frame means.

4. The exercise apparatus as claimed in claim 1, wherein said power translating mechanism comprises:

at least one lever pivotally mounted at its proximate center to said structural frame means and having end segments pivotally connected to said foot engaging members, said lever end segments being adaptable adjustable to compensate for the different vertical positions of said foot engaging members, whereby the force exerted downward on one foot engaging member by the foot of the user produces an upward force on the other foot engaging member.

5. The exercise apparatus as claimed in claim 4, wherein each end segment of said lever is connected to each of said foot engaging members at multiple connection points, each end segment being adaptably adjustable to compensate for the multiple connection points and the different vertical positions of said foot engaging members, said lever allowing said foot engaging member to maintain a substantially horizontal position as said foot engaging member moves in a substantially vertical direction.

6. The exercise apparatus as claimed in claim 5, wherein said power translating mechanism further comprises a shaft member, said lever rigidly mounted at its proximate centers to said shaft member, said shaft member being turnably mounted to said structural frame means.

7. An exercise apparatus comprising:

a structural frame means;

two foot engaging members, both coupled to said structural frame means to move in a substantially vertical direction; and a power translating mechanism operatively connecting said said foot engaging members and said structural frame means for translating the downward force applied to one of said foot engaging members into an upward force on the second of said foot engaging members, thereby moving said foot engaging members in opposite directions from one another, whereby the user may perform a stepping exercise routine whereby the feet of the user move opposite one another in a substantially vertical direction;

said power translating mechanism comprises at least one lever pivotally mounted at its proximate center to said structural frame means and having end segments pivotally connected to said foot engaging members, said lever end segments being adaptable adjustable to compensate for the different vertical positions of said foot engaging members, whereby the force exerted downward on one foot engaging member by the foot of the user produces an upward force on the other foot engaging member.

8. The exercise apparatus as claimed in claim 7, said structural frame means comprising:

a rigid frame; and guide members mounted to said rigid frame, said guide members being mounted near the front and rear of said rigid frame.

9. The exercise apparatus as claimed in claim 8, wherein each of said guide members of said structural frame means comprises an elongated structure extending in a substantially vertical direction.

10. The exercise apparatus as claimed in claim 9, wherein each of said foot engaging member comprises:

a relatively flat structure upon which a user places a foot while in a standing position; and guide openings extending in a substantially vertical direction through said flat structure, at least one guide opening located near the front of said flat structure and loosely receiving one of said guide members mounted near the front of said rigid frame of said structural frame means, and at least one other guide opening located near the rear of said flat structure and loosely receiving one of said guide members mounted near the rear of said rigid frame of said structural frame means, thereby coupling said foot engaging member to said structural frame means.

11. The exercise apparatus as claimed in claim 7, wherein each end segment of said lever is connected to each of said foot engaging members at multiple connection points, each end segment being adaptably adjustable to compensate for the multiple connection points and the different vertical positions of said foot engaging members, said lever allowing said foot engaging member to maintain a substantially horizontal position as said foot engaging member moves in a substantially vertical direction.

12. The exercise apparatus as claimed in claim 11, wherein said power translating mechanism further comprises a shaft member, said lever rigidly mounted at its proximate centers to said shaft member, said shaft member being turnably mounted to said structural frame means.

* * * * *